US012241272B1

(12) United States Patent
Li

(10) Patent No.: US 12,241,272 B1
(45) Date of Patent: Mar. 4, 2025

(54) SWIMMING POOL COVER

(71) Applicant: Jinxin Li, Guangdong (CN)

(72) Inventor: Jinxin Li, Guangdong (CN)

( * ) Notice: Subject to any disclaimer, the term of this patent is extended or adjusted under 35 U.S.C. 154(b) by 0 days.

(21) Appl. No.: 18/777,554

(22) Filed: Jul. 19, 2024

(30) Foreign Application Priority Data

Jul. 8, 2024 (CN) ..... 202421611137.6

(51) Int. Cl.
*E04H 4/10* (2006.01)

(52) U.S. Cl.
CPC ..... *E04H 4/108* (2013.01)

(58) Field of Classification Search
CPC ..... E04H 4/108; E04H 4/10
USPC ..... 4/498
See application file for complete search history.

(56) References Cited

U.S. PATENT DOCUMENTS 3,354,472 A * 11/1967 Steinbeck ..... E04H 4/10 4/503
5,826,283 A * 10/1998 Edwards ..... E04H 4/10 4/503
6,286,157 B1 * 9/2001 Baumann ..... E04H 4/103 4/503
2006/0060831 A1 * 3/2006 Seas ..... E04H 4/06 256/24
2010/0058529 A1 * 3/2010 Decker ..... E04H 4/103 4/499

* cited by examiner

*Primary Examiner* — Huyen D Le

(57) ABSTRACT

A swimming pool cover includes a flexible cover layer, a flexible surrounding edge, a flexible wrapping edge, a tightening wire, and a tightening device. The swimming pool cover is configured to completely cover the surface of a swimming pool and provide a good protection from being blown away from the pool in windy weather.

18 Claims, 5 Drawing Sheets

SWIMMING POOL COVER

CROSS-REFERENCE TO RELATED APPLICATIONS

The application claims priority of Chinese patent application CN202421611137 6, filed on Jul. 8, 2024, which is incorporated herein by reference in its entirety.

TECHNICAL FIELD

The utility model relates to the field of swimming pool covers, in particular to a swimming pool cover.

BACKGROUND

With the improvement of people's living standards, home swimming pools have become increasingly popular in the hot summer. However, maintaining an outdoor independent swimming pool is a problem. Exposed swimming pools are prone to accumulate dust, fallen leaves, insects and other debris that can pollute the pool water, increasing the frequency and cost of cleaning and maintenance.

At present, swimming pool covers on the market are usually made of light and thin materials. In actual use, due to the light fabric of the swimming pool cover, when encountering windy weather, the swimming pool cover is easily blown up or even blown away by the wind, causing the swimming pool to be exposed to the outside, affecting the use effect.

Therefore, there is an urgent need for a swimming pool cover on the market that is not easy to fall off from the swimming pool and has better protective performance, so as to provide a better user experience.

SUMMARY

The main purpose of the present disclosure is to provide a swimming pool cover to solve the problem that the existing swimming pool covers.

A technical solution adopted by the present disclosure to solve the technical problem is as follows.

A swimming pool cover includes a flexible cover layer configured to completely cover a surface of a swimming pool; a flexible surrounding edge extending downwardly from an outer edge of the flexible cover layer, so that the flexible surrounding edge is suspended on an outer side wall of the swimming pool; a flexible wrapping edge connected around a lower end of the flexible surrounding edge, and the flexible wrapping edge being provided with a plurality of fourth threading holes; and a tightening wire passing through the plurality of the fourth threading holes to attach the flexible wrapping edge to the outer side wall of the swimming pool.

Further, the swimming pool cover further includes a tightening device wherein the tightening device is arranged on the tightening wire, and the tightening device is configured to adjust a tightening length of the tightening wire so that the flexible wrapping edge is able to be attached on the outer side wall of the swimming pool of different sizes.

Further, the tightening device is a wire twister, the tightening device includes a wire twister shell and a wire winding rod, the wire twister shell includes an upper shell, a lower shell arranged opposite to the upper shell, a left shell and a right shell, the left shell and the right shell are connected to the upper shell and the lower shell and are arranged opposite to each other, two ends of the wire winding rod are inserted between the upper shell and the lower shell, and the wire winding rod is also connected to a rotating device, and the wire winding rod is configured to be rotated relative to the wire twister shell through the rotating device.

Further, the wire twister further includes an one-way rotation mechanism, the one-way rotation mechanism is connected to the wire winding rod so that the wire winding rod is able to continuously rotate one-way relative to the wire twisting shell.

Further, the rotating device is a rotating arm, one end of the wire winding rod passes through the upper shell and is connected to the rotating arm, and the wire winding rod is rotated relative to the wire twister shell by twisting the rotating arm.

Further, the rotating arm includes a first rotating arm and a second rotating arm, the first rotating arm and the second rotating arm are both in a "V" shape.

Further, the one-way rotation mechanism includes a ratchet provided between the rotation device and the upper shell and a pawl engaged with the ratchet, the pawl is fixed to the upper shell by a pawl bolt and is rotatable around the pawl bolt, and the upper shell is provided with an elastic device, the elastic device is pressed against one end of the pawl away from the ratchet so that the other end of the pawl is engaged with the ratchet.

Further, the elastic device is a spring of "U" shape, the upper shell is provided with a limiting hole, the spring is located in the limiting hole, the spring includes a first elastic column and a second elastic column, the first elastic column is pressed against the upper shell, and the second elastic column is pressed against the pawl.

Further, the left shell is provided with a first threading hole, the right shell is provided with a second threading hole, and the wire winding rod is provided with a third threading hole, one end of the tightening wire is able to pass through the first threading hole and the third threading hole in sequence and is wound around the wire winding rod, and the other end of the tightening wire is able to pass through the second threading hole and the third threading hole in sequence and is wound around the wire winding rod.

Further, the first threading hole is provided with a first threading sleeve, and the second threading hole is provided with a second threading sleeve.

Further, the flexible wrapping edge includes a first layer of wrapping edge and a second layer of wrapping edge connected to the first layer of wrapping edge, and the first layer of wrapping edge and the second layer of wrapping edge are clamped and fixed to front and back sides of the flexible surrounding edge respectively.

Further, the first layer of wrapping edge and the second layer of wrapping edge are clamped to front and back sides of the flexible surrounding edge by sewing.

Further, at least one of the fourth threading holes is provided with a threading ring.

Further, the threading ring is a steel threading ring.

Further, at least one of the flexible cover layer and the flexible surrounding edge is made of oxford fabric.

Further, the sides of the flexible cover layer and the flexible surrounding edge in contact with the swimming pool is covered with a silver heat-insulating coating.

Further, the outer edge of the tightening wire is wrapped with a flexible protective layer.

Further, the tightening wire is a steel wire, and the flexible protective layer is a transparent plastic sleeve.

Further, a diameter of the flexible cover layer ranges from 480 cm-1000 cm.

Further, a height of the swimming pool cover ranges from 15 cm-41 cm.

Through the above structure, the flexible cover layer is completely covered on the surface of the swimming pool, which can effectively block dust, fallen leaves, insects and other debris from entering the swimming pool, thereby keeping the pool water clean and reducing the frequency of cleaning and maintenance costs. The flexible surrounding edge extending from the outer edge of the flexible cover layer enables the swimming pool cover to be covered on the swimming pool in the form of a sleeve, increasing the stability of the swimming pool cover, and the lower end of the flexible surrounding edge is also connected to the flexible wrapping edge 3. By passing the tightening wire through a plurality of threading holes provided on the flexible wrapping edge, the tightening wire tightens the flexible wrapping edge while tightening the flexible surrounding edge and the flexible cover layer to the outer side wall of the swimming pool, thereby further enhancing the wind resistance of the swimming pool cover, even in windy weather it is not easy to be blown up or blown away. The flexible wrapping edge is designed to prevent the tightening wire from damaging the flexible surrounding edge, avoiding friction and pulling of the tightening wire on the flexible surrounding edge, thereby improving the overall durability and service life of the swimming pool cover.

BRIEF DESCRIPTION OF THE DRAWINGS

In order to explain the technical solutions of the embodiments of the present disclosure more clearly, the following will briefly introduce the accompanying drawings used in the embodiments. Apparently, the drawings in the following description are only some embodiments of the present disclosure. Those of ordinary skill in the art can obtain other drawings based on these drawings without creative work.

DETAILED DESCRIPTION OF THE EMBODIMENTS

The technical solutions in the embodiments of the present disclosure will be clearly and completely described below in conjunction with the accompanying drawings in the embodiments of the present disclosure. Apparently, the described embodiments are only a part of the embodiments of the present disclosure, rather than all the embodiments. Based on the embodiments in the present disclosure, all other embodiments obtained by those ordinarily skilled in the art without doing creative work shall fall within the protection scope of the present disclosure.

Figure 1:
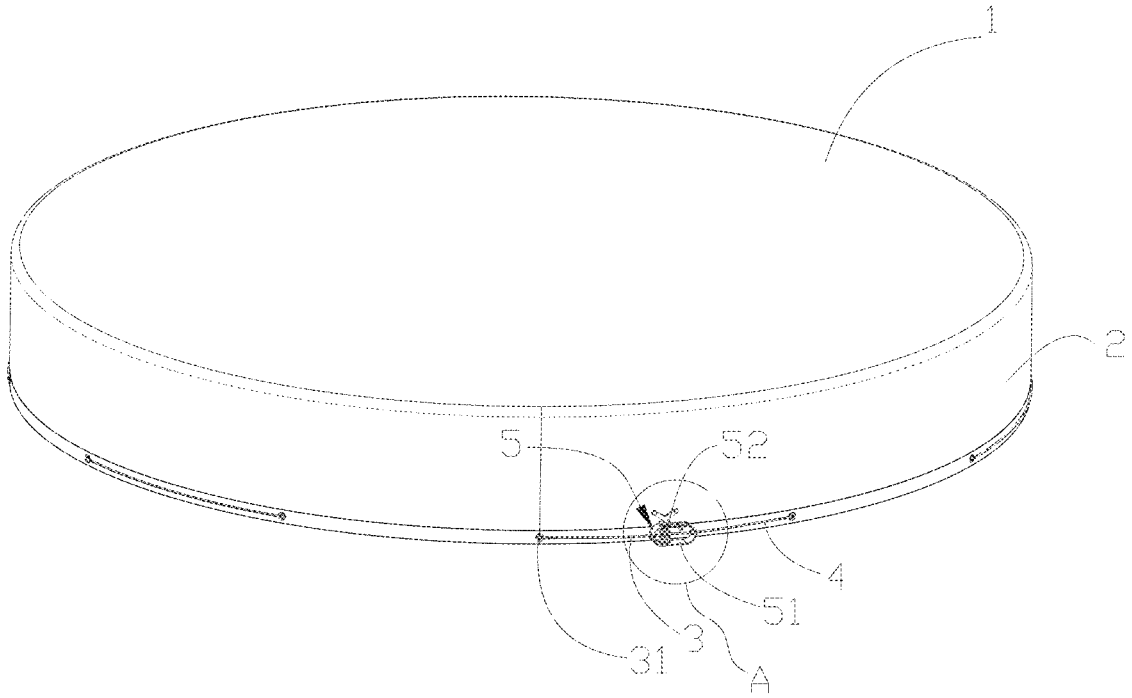
FIG. 1 is a schematic diagram of the overall structure of the present utility model.
Figure 2:
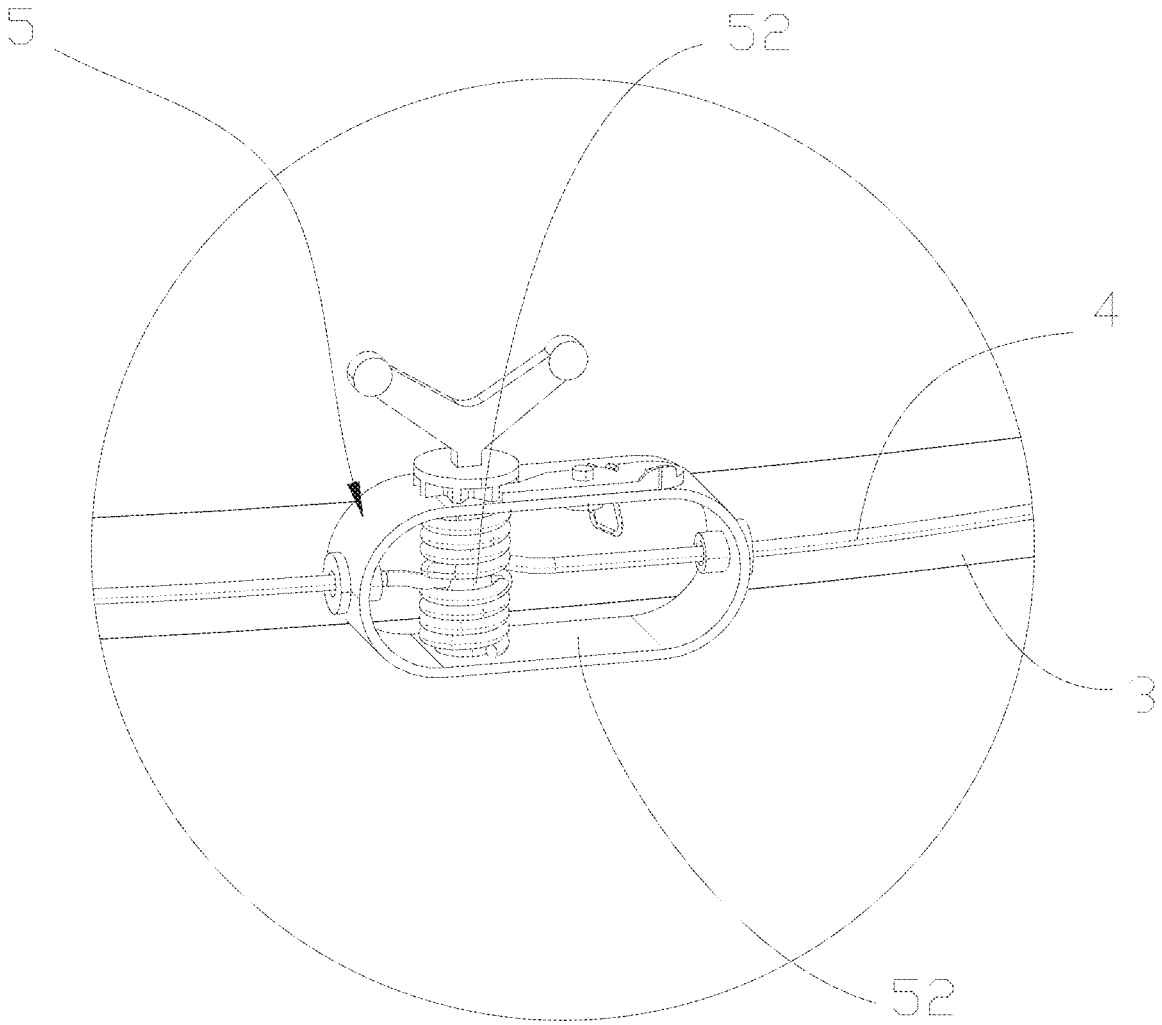
FIG. 2 is an enlarged view of a part A in FIG. 1.
Figure 3:
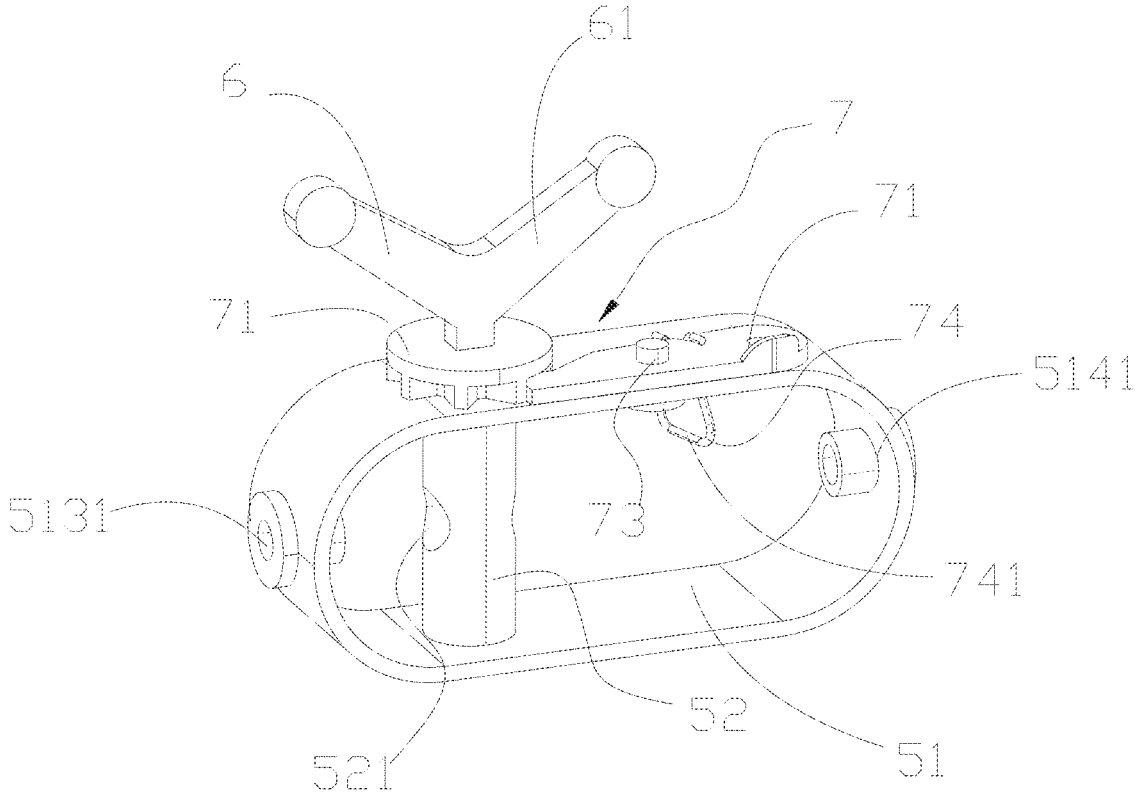
FIG. 3 is a schematic diagram of a tightening device of the present utility model.
Figure 4:
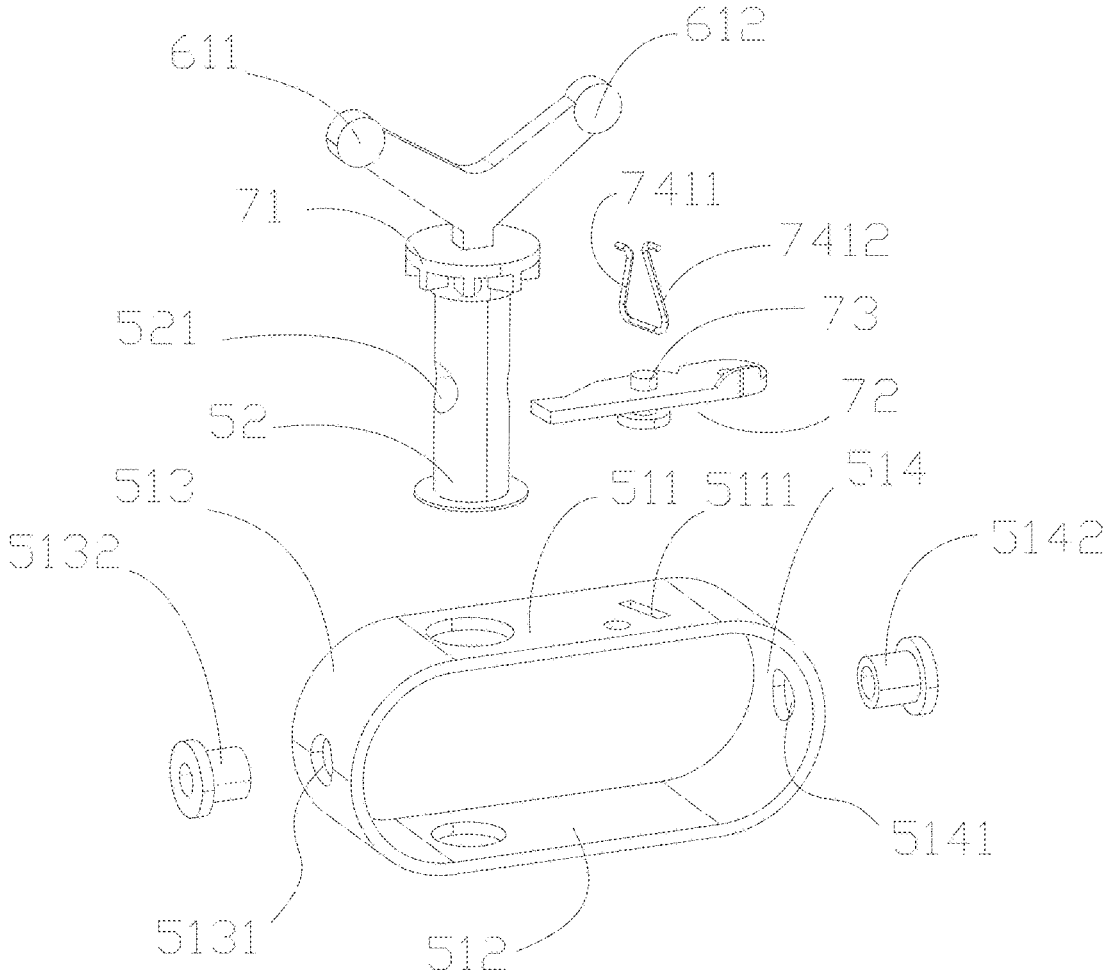
FIG. 4 is an exploded view of a tightening device of the present utility model.
Figure 5:
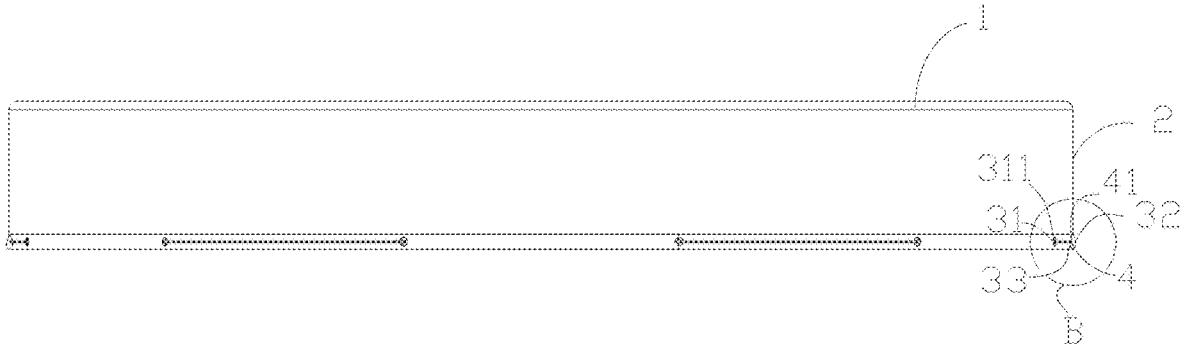
FIG. 5 is a cross-sectional view of the present utility model taken along a tightening wire.
Figure 6:
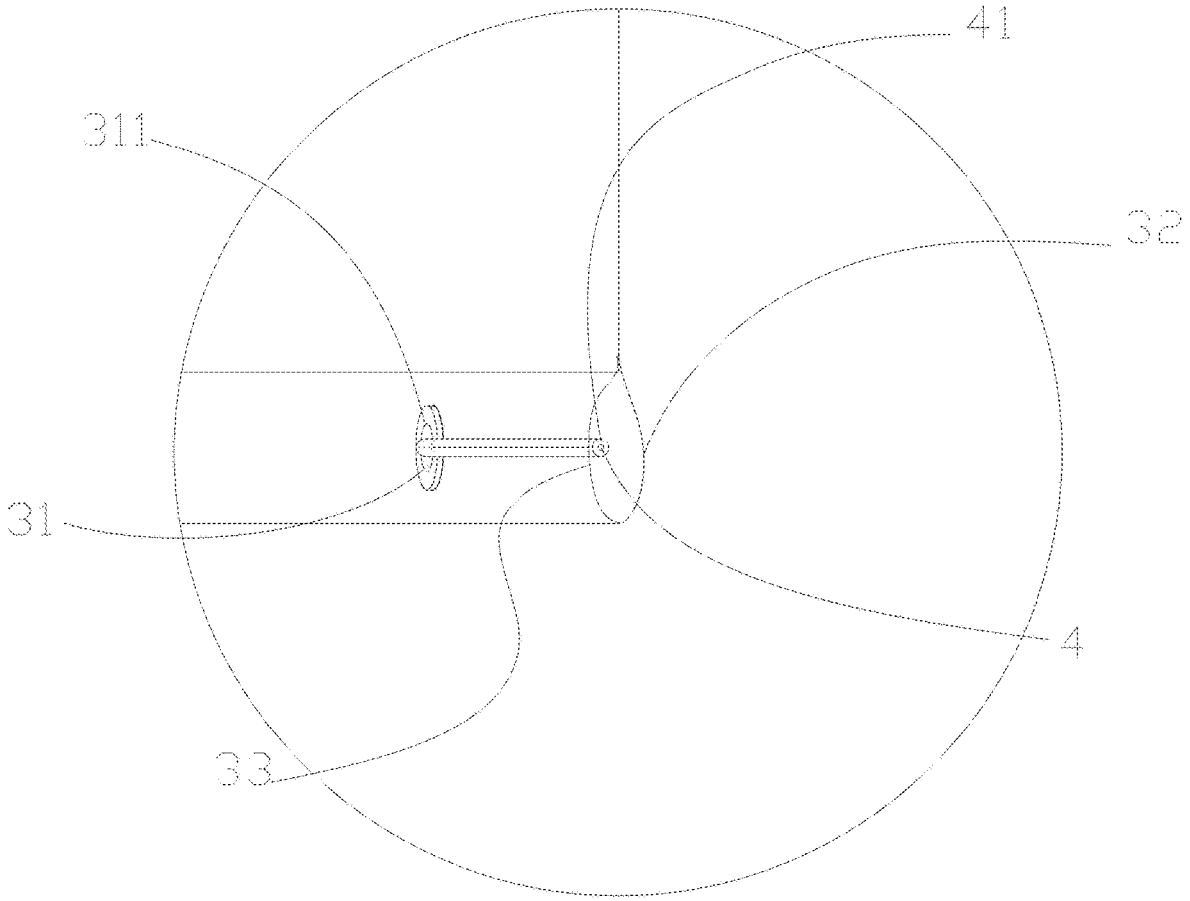
FIG. 6 is an enlarged view of a point B in FIG. 5.

Refer to FIGS. 1-6, a swimming pool cover includes a flexible cover layer 1, wherein the flexible cover layer 1 is configured to completely cover a surface of a swimming pool; a flexible surrounding edge 2, wherein the flexible surrounding edge 2 extends downwardly from an outer edge of the flexible cover layer 1, so that the flexible surrounding edge 2 is suspended on an outer side wall of the swimming pool; a flexible wrapping edge 3, wherein the flexible wrapping edge 3 is connected around a lower end of the flexible surrounding edge 2, and the flexible wrapping edge 3 is provided with a plurality of fourth threading holes 31; and a tightening wire 4, wherein the tightening wire 4 passes through the plurality of the fourth threading holes 31 to attach the flexible wrapping edge 3 to the outer side wall of the swimming pool. Through the above structure, the flexible cover layer 1 is completely covered on the surface of the swimming pool, which can effectively block dust, fallen leaves, insects and other debris from entering the swimming pool, thereby keeping the pool water clean and reducing the frequency of cleaning and maintenance costs. The flexible surrounding edge 2 extending from the outer edge of the flexible cover layer 1 enables the swimming pool cover to be covered on the swimming pool in the form of a sleeve, increasing the stability of the swimming pool cover, and the lower end of the flexible surrounding edge 2 is also connected to the flexible wrapping edge 3. By passing the tightening wire 4 through a plurality of threading holes provided on the flexible wrapping edge 3, the tightening wire 4 tightens the flexible wrapping edge 3 while tightening the flexible surrounding edge 2 and the flexible cover layer to the outer side wall of the swimming pool, thereby further enhancing the wind resistance of the swimming pool cover, even in windy weather it is not easy to be blown up or blown away. The flexible wrapping edge 3 is designed to prevent the tightening wire 4 from damaging the flexible surrounding edge 2, avoiding friction and pulling of the tightening wire 4 on the flexible surrounding edge 2, thereby improving the overall durability and service life of the swimming pool cover.

In this embodiment, a tightening device 5 is also included. The tightening device 5 is arranged on the tightening wire 4, and the tightening device 5 is configured to adjust a tightening length of the tightening wire 4 so that the flexible wrapping edge 3 is able to be attached on the outer side wall of the swimming pool of different sizes. Through the above structure, the tightening device 5 enhances the adaptability of the swimming pool cover. For swimming pools with a certain size variation, the user can adjust the tightening length of the tightening wire 4 by adjusting the tightening device 5, which greatly improves the stability and convenience of using the swimming pool cover.

Specifically, the tightening device 5 is a wire twister, the tightening device 5 includes a wire twister shell 51 and a wire winding rod 52, the wire twister shell 51 includes an upper shell 511, a lower shell 512 arranged opposite to the upper shell 511, a left shell 513 and a right shell 514, the left shell 513 and the right shell 514 are connected to the upper shell 511 and the lower shell 512 and are arranged opposite to each other, two ends of the wire winding rod 52 are inserted between the upper shell 511 and the lower shell 512, and the wire winding rod 52 is also connected to a rotating device 6, and the wire winding rod 52 is configured to be rotated relative to the wire twister shell through the rotating device 6. Through the above structure, the tightening wire 4 is brought into contact with the wire winding rod 52, and then the wire winding rod 52 is rotated by twisting the rotating device 6. When the wire winding rod 52 rotates, the tightening wire 4 is gradually wound around the wire winding rod 52, and the length of the tightening wire 4 is shortened, so that the flexible wrapping edge 3 is gradually tightened and fits against the outer side wall of the swimming pool, so that the swimming pool cover is configured to be firmly installed on the outside of the swimming pool. Conversely, if the tightening wire 4 needs to be loosened, the rotating device 6 needs to be twisted in the opposite direction to gradually unwind the tightening wire 4 from the wire winding rod 52, and then the swimming pool cover is configured to be taken off the swimming pool.

Furthermore, the rotating device 6 is a rotating arm 61, one end of the wire winding rod 52 passes through the upper shell 511 and is connected to the rotating arm 61, and the wire winding rod 52 is rotated relative to the wire twister shell by twisting the rotating arm 61. The rotating arm 61 includes a first rotating arm 611 and a second rotating arm 612, the first rotating arm 611 and the second rotating arm 612 are both in a "V" shape. Through the above structure, the user can place fingers respectively on the first rotating arm 611 and the second rotating arm 612 of the "V" shape and perform a relative twisting action to realize the rotation of the wire winding rod 52, enabling the wire winding rod 52 to rotate more easily. Even when the tightening wire 4 requires a large tensile force, the adjustment can be easily completed. A "V" shape design provides a more comfortable grip, which makes the user more labor-saving when adjusting and improves the user experience.

In this embodiment, the wire twister further includes an one-way rotation mechanism 7, the one-way rotation mechanism 7 is connected to the wire winding rod 52 so that the wire winding rod 52 is able to continuously rotate one-way relative to the wire twisting shell 51. Through the above structure, the one-way rotation mechanism 7 can prevent the tightening wire 4 from loosening or slipping off after being adjusted. After the length of the tightening wire 4 has been adjusted, the tightening wire 4 will remain at a set length and tightness and will not change due to external forces.

Further, the one-way rotation mechanism 7 includes a ratchet 71 provided between the rotation device 6 and the upper shell 511 and a pawl 72 engaged with the ratchet 71, the pawl 72 is fixed to the upper shell 511 by a pawl bolt 73 and is rotatable around the pawl bolt 73, and the upper shell 511 is provided with an elastic device 74, the elastic device 74 is pressed against one end of the pawl 72 away from the ratchet 71 so that the other end of the pawl 72 is engaged with the ratchet 71. Specifically, the elastic device 74 is a spring 741 of "U" shape, the upper shell 511 is provided with a limiting hole 5111, the spring 741 is located in the limiting hole 5111, the spring 741 includes a first elastic column 7411 and a second elastic column 7412, the first elastic column 7411 is pressed against the upper shell 511, and the second elastic column 7412 is pressed against the pawl 72. Through the above structure, the presence of the elastic device 74 ensures that the pawl 72 always remains engaged with the ratchet 71 during the rotation process, preventing the reverse rotation of the wire winding rod 52 during release, thereby maintaining a tensioning state of the tightening wire 4, effectively ensuring that the tightening wire 4 can only be tensioned in one direction, avoiding loosening or slipping off due to external factors, and improving the stability of the tightening device 5. This design is simple and reliable, ensuring the stability and reliability of the swimming pool cover.

In this embodiment, the left shell 513 is provided with a first threading hole 5131, the right shell 514 is provided with a second threading hole 5141, and the wire winding rod 52 is provided with a third threading hole 521, one end of the tightening wire 4 is able to pass through the first threading hole 5131 and the third threading hole 521 in sequence and is wound around the wire winding rod 52, and the other end of the tightening wire 4 is able to pass through the second threading hole 5141 and the third threading hole 521 in sequence and is wound around the wire winding rod 52. Through the above structure, by passing two ends of the tensioning wire 4 through the first threading hole 5131 of the left shell 513 and the second threading hole 5141 of the right shell 514 respectively, while twisting the rotating arm 61 to move the wire winding rod 52, two ends of the tensioning wire 4 are respectively wound around the wire winding rod 52. With multiple rotations of the wire winding rod 52, the intersection length of the tensioning wire 4 becomes smaller, thereby effectively achieving the result that the tensioning wire 4 tightens the swimming pool cover to the outer wall of the swimming pool.

In this embodiment, the first threading hole 5131 is provided with a first threading sleeve 5132, and the second threading hole 5141 is provided with a second threading sleeve 5142. Wherein the surface of the threading sleeve is made of smooth plastic material, and its surface smoothness can reduce the friction resistance of the tightening wire 4 during the threading process, making it easier for the tightening wire 4 to pass through the threading hole, and reducing the resistance and wear during operation.

In this embodiment, the flexible wrapping edge 3 includes a first layer of wrapping edge 32 and a second layer of wrapping edge 33 connected to the first layer of wrapping edge 32, and the first layer of wrapping edge 32 and the second layer of wrapping edge 33 are clamped and fixed to front and back sides of the flexible surrounding edge 2 respectively. The first layer of wrapping edge 32 and the second layer of wrapping edge 33 are clamped to front and back sides of the flexible surrounding edge (2) by sewing. Wherein the material of the flexible wrapping edge 3 has better durability and structural strength than the flexible surrounding edge 2 and the flexible cover layer 1, and it is configured to be made of cheesecloth, canvas, etc. Through the above structure, a two-layer structure of the flexible wrapping edge 3 is stronger and more durable than the flexible surrounding edge 2, and improves the stability and durability of the swimming pool cover when the tightening wire 4 tightens it.

In this embodiment, at least one of the fourth threading holes 31 is provided with a threading ring 311. In addition, the threading ring 311 is a steel threading ring 311. Through the above structure, the steel threading ring 311 provides good durability and strength to ensure that the tightening wire 4 is not easily damaged during use and the flexible wrapping edge 3 is not easily torn.

In this embodiment, the flexible cover layer 1 and the flexible surrounding edge 2 are both made of oxford fabric. Through the above structure, the oxford cloth has a waterproof effect. With its good waterproof performance, the oxford cloth is configured to effectively prevent water from penetrating into the swimming pool. In addition, the oxford cloth is relatively lightweight, making it convenient for carrying and installing the swimming pool cover.

In this embodiment, the sides of the flexible cover layer 1 and the flexible surrounding edge 2 in contact with the swimming pool is covered with a silver heat-insulating coating. Through the above structure, a silver heat-insulating coating is configured to reduce the absorption and conduction of heat, helping to keep the/a water temperature of the swimming pool relatively stable.

In this embodiment, the outer edge of the tightening wire 4 is wrapped with a flexible protective layer 41. The tightening wire 4 is a steel wire, and the flexible protective layer 41 is a transparent plastic sleeve. Through the above structure, the plastic sleeve is configured to reduce the potential risk of damage to the spool cover fabric or personnel by the sharp steel wire, improving the use safety, and the plastic sleeve is configured to reduce the friction between the steel tightening wire 4 and the fabric, thereby reducing wear and loss and maintaining the function and strength of the tightening wire 4.

In this embodiment, a diameter of the flexible cover layer 1 ranges from 480 cm-1000 cm; a height of the swimming pool cover ranges from 15 cm-41 cm. Wherein, the height of the swimming pool cover refers to the height from the bottom surface of the flexible wrapping edge 3 to the top surface of the flexible cover layer 1. In general swimming pool cover products, when the diameter of the flexible cover layer 1 is less than 550 cm, the height of the swimming pool cover is 20 cm; when the diameter of the flexible cover layer 1 is greater than 550 cm, the height of the swimming pool cover is 30 cm, so as to prevent the swimming pool cover from slipping off due to the excessive area of the flexible cover layer 1 and the excessively small height of the flexible surrounding edge 2.

The above descriptions are only preferred embodiments of the present disclosure, and are not intended to limit the patent scope of the present disclosure. Any equivalent structural transformation made by using the content of the specification and the drawings of the present disclosure under the invention idea of the present disclosure, directly or indirectly applied to other related technical fields, shall all be included in the scope of patent protection of the present disclosure.

What is claimed is:

1. A swimming pool cover, comprising:

a flexible cover layer, the flexible cover layer configured to completely cover a surface of a swimming pool;

a flexible surrounding edge, the flexible surrounding edge extending downwardly from an outer edge of the flexible cover layer, so that the flexible surrounding edge is suspended on an outer side wall of the swimming pool;

a flexible wrapping edge, the flexible wrapping edge being connected around a lower end of the flexible surrounding edge, and the flexible wrapping edge being provided with a plurality of fourth threading holes;

a tightening wire, the tightening wire passing through the plurality of the fourth threading holes to attach the flexible wrapping edge to the outer side wall of the swimming pool; and a tightening device, wherein the tightening device is arranged on the tightening wire, and the tightening device is configured to adjust a tightening length of the tightening wire so that the flexible wrapping edge is able to be attached on the outer side wall of the swimming pool of different sizes;

wherein the tightening device is a wire twister, the tightening device comprises a wire twister shell and a wire winding rod, the wire twister shell comprises an upper shell, a lower shell arranged opposite to the upper shell, a left shell and a right shell, the left shell and the right shell are connected to the upper shell and the lower shell and are arranged opposite to each other, two ends of the wire winding rod are inserted between the upper shell and the lower shell, and the wire winding rod is also connected to a rotating device, and the wire winding rod is configured to be rotated relative to the wire twister shell through the rotating device.

2. The swimming pool cover according to claim 1, wherein the wire twister further comprises an one-way rotation mechanism, the one-way rotation mechanism is connected to the wire winding rod so that the wire winding rod is able to continuously rotate one-way relative to the wire twisting shell.

3. The swimming pool cover according to claim 1, wherein the rotating device is a rotating arm, one end of the wire winding rod passes through the upper shell and is connected to the rotating arm, and the wire winding rod is rotated relative to the wire twister shell by twisting the rotating arm.

4. The swimming pool cover according to claim 3, wherein the rotating arm comprises a first rotating arm and a second rotating arm, the first rotating arm and the second rotating arm are both in a "V" shape.

5. The swimming pool cover according to claim 4, wherein the one-way rotation mechanism comprises a ratchet provided between the rotation device and the upper shell and a pawl engaged with the ratchet, the pawl is fixed to the upper shell by a pawl bolt and is rotatable around the pawl bolt, and the upper shell is provided with an elastic device, the elastic device is pressed against one end of the pawl away from the ratchet so that the other end of the pawl is engaged with the ratchet.

6. The swimming pool cover according to claim 5, wherein the elastic device is a spring of "U" shape, the upper shell is provided with a limiting hole, the spring is located in the limiting hole, the spring comprises a first elastic column and a second elastic column, the first elastic column is pressed against the upper shell, and the second elastic column is pressed against the pawl.

7. The swimming pool cover according to claim 1, wherein the left shell is provided with a first threading hole, the right shell is provided with a second threading hole, and the wire winding rod is provided with a third threading hole, one end of the tightening wire is able to pass through the first threading hole and the third threading hole in sequence and is wound around the wire winding rod, and the other end of the tightening wire is able to pass through the second threading hole and the third threading hole in sequence and is wound around the wire winding rod.

8. The swimming pool cover according to claim 7, wherein the first threading hole is provided with a first threading sleeve, and the second threading hole is provided with a second threading sleeve.

9. The swimming pool cover according to claim 8, wherein at least one of the flexible cover layer and the flexible surrounding edge is made of oxford fabric.

10. The swimming pool cover according to claim 8, wherein the sides of the flexible cover layer and the flexible surrounding edge in contact with the swimming pool is covered with a silver heat-insulating coating.

11. The swimming pool cover according to claim 8, wherein the outer edge of the tightening wire is wrapped with a flexible protective layer.

12. The swimming pool cover according to claim 11, wherein the tightening wire is a steel wire, and the flexible protective layer is a transparent plastic sleeve.

13. The swimming pool cover according to claim 1, wherein the flexible wrapping edge comprises a first layer of wrapping edge and a second layer of wrapping edge connected to the first layer of wrapping edge, and the first layer of wrapping edge and the second layer of wrapping edge are clamped and fixed to front and back sides of the flexible surrounding edge respectively.

14. The swimming pool cover according to claim 13, wherein the first layer of wrapping edge and the second layer of wrapping edge are clamped to front and back sides of the flexible surrounding edge by sewing.

15. The swimming pool cover according to claim 1, wherein at least one of the fourth threading holes is provided with a threading ring.

16. The swimming pool cover according to claim 15, wherein the threading ring is a steel threading ring.

17. The swimming pool cover according to claim 1, wherein a diameter of the flexible cover layer ranges from 480 cm-1000 cm.

18. The swimming pool cover according to claim 1, wherein a height of the swimming pool cover ranges from 15 cm-41 cm.

* * * * *